United States Patent [19]

Schwelling

[11] Patent Number: 4,809,916

[45] Date of Patent: Mar. 7, 1989

[54] WIPER FOR THE CUTTING MECHANISM OF A SHREDDER

[76] Inventor: Hermann Schwelling, Bahnhofstrasse 115, D-7777 Salem 3/Neufrach, Fed. Rep. of Germany

[21] Appl. No.: 96,677

[22] Filed: Sep. 14, 1987

[30] Foreign Application Priority Data

Sep. 15, 1986 [DE] Fed. Rep. of Germany ..... 3631362

[51] Int. Cl.[4] ..... B02C 18/06

[52] U.S. Cl. ..... 241/166; 241/236

[58] Field of Search ..... 241/236, 235, 166, 167

[56] References Cited

U.S. PATENT DOCUMENTS 4,562,971 1/1986 Schwelling ..... 241/236

4,688,730 8/1987 Dahle ..... 241/236 X

FOREIGN PATENT DOCUMENTS 517676 9/1976 U.S.S.R. ..... 241/236

2096017 10/1982 United Kingdom ..... 241/236

*Primary Examiner*—Mark Rosenbaum

*Attorney, Agent, or Firm*—Toren, McGeady & Associates

[57] ABSTRACT

In a cutting mechanism for shredders fabricated in compact construction it is provided as far as the arrangement of support rods for the wipers is concerned, that within each of the pair of wipers (3, 4) the base parts (3a,4a) approach each other to such an extent that the second support rod (6) located there serves as a common support rod (6) for the one (3) as well as the other (4) of the respective pair of wipers (3, 4).

8 Claims, 1 Drawing Sheet

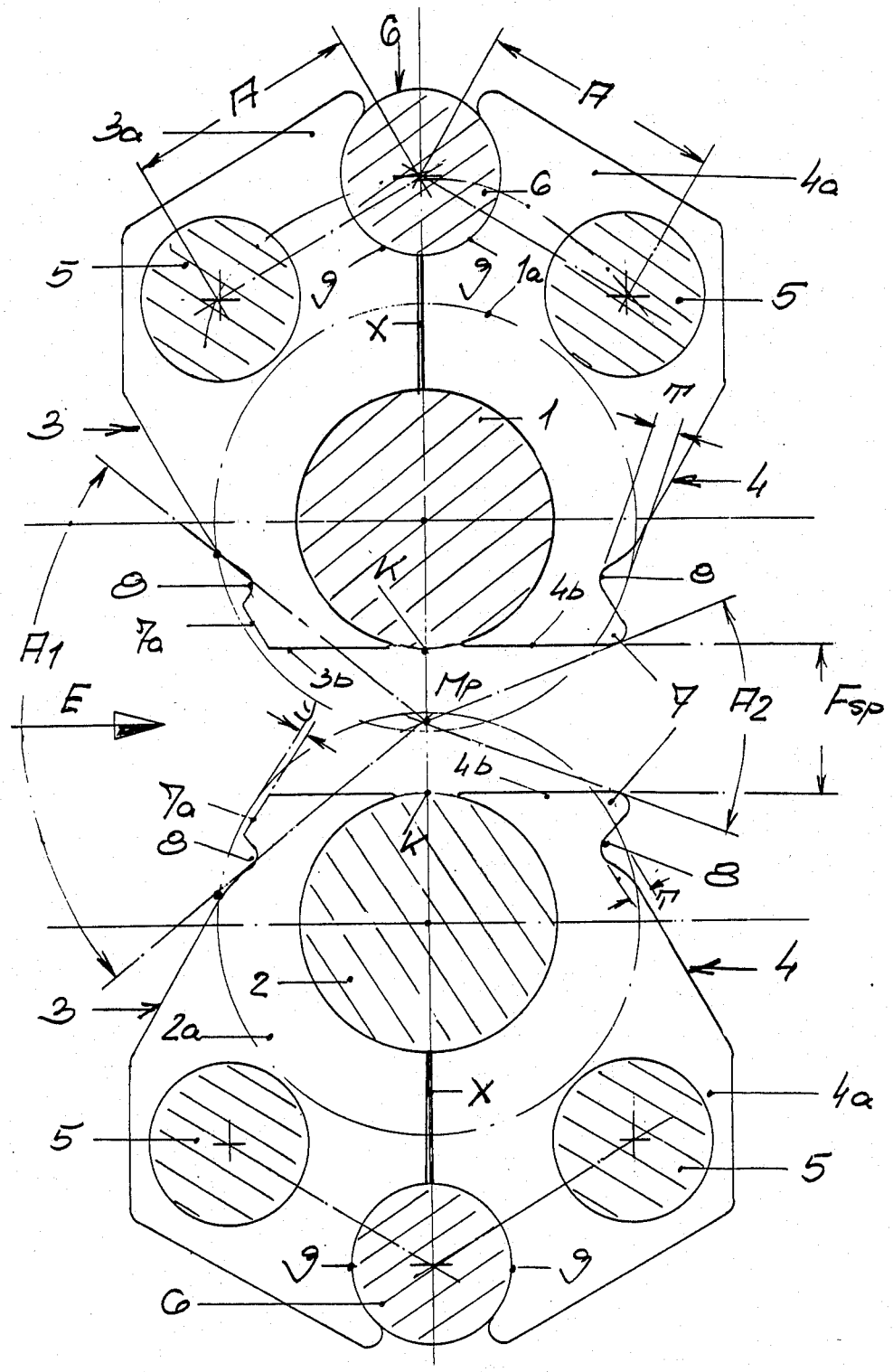
6
A
A
3a
4a
6
5
9
9
1a
5
X
1
3
4
K
4b
8
8
7a
A1
3b
Mp
E
7
A2
Fsp
4b
7a
8
K
8
4
2
3
2a
X
4a
5
5
9
9
6

WIPER FOR THE CUTTING MECHANISM OF A SHREDDER

The invention is directed to a wiper for cutting mechanisms of shredders. The task of the present invention consists in simplifying the cutting mechanisms of known construction, as well as making them even more compact and lighter at the same output as well as improving the function of the material intake and the wiper effect during the roller advance and return stroke.

The drawing shows mainly schematically the cross-section of a cutting mechanism with a new wiper design.

The depicted cutting mechanism consists in its basic construction in a known manner to begin with that the core parts 1 or 2 of the slitting rollers support the disk-like cutters 1*a* and 2*a* as well as the wipers 3 and 4 which embraces the respective roller cores 1 and 2 in semi-shell-shaped manner.

The invention accomplishes the previously defined tasks, in order to achieve constructional compactness and saving of material or reduction of weight, by providing that within each pair of wipers 3, 4 that the base parts 3*a* and 4*a* are so near to one another that the second support rod 6 located there serves as common support rod 6 for both of the one-half 3 wipers of the respective pair of wipers 3, 4, wherein preferably in addition the wipers 3, 4 of each pair in the base region 3*a*, 4*a* rest at each other and/or at the respective roller cores 1 or 2 and that the common support rod 6 of each pair of wipers 3, 4 is inserted into a dish- or cavity-shaped recess 9 of each of the wiper parts 3 or 4. Irrespectively of how the top parts 3*b* or 4*b* of the wipers 3 or 4 are now stressed during the roller advance or return stroke, the load is always carried by two of the rods 5 and 6, even the other rod 5 is also able to carry some of the stress.

Another important feature is that the top portions of the wipers 3*b*, 4*b* of each pair of wipers extend up to the approximately inner boundaries "K" of the roller core 1 or 2 which face each other, with formation of a preferably parallel conveyor gap "Fsp" and that the wiper top portions 3*b* and 4*b* adjacent to their respective regions extending in the conveyor gap "Fsp" are equipped with at least one lug 7 projecting from the circumference of the cutting disks 1*a*, 2*a* and also have a necked-down a recessed portion 8 extending in direction to the respective base portions 3*a*, 4*b*, which or recessed portion swings again in a curved manner up to the inner sides of the cutting disk outer circumference 1*a*, 2*a*. This design on the one hand prevents excessive compression forces from arising upon the wiper top portions 3*b* and 4*b* at the outlet side of the shredded material and on the other hand affords a good wipe off function for this material during the roller return stroke. It is important for this that the depth "T" of the necked-down portion 8 is at least equal, preferably however deeper than that of the transverse groove (not depicted) of the cutting disks 1*a*, 2*a*. Finally, the additional intake- or feed roller for crumpled paper or the like always required hitherto in the state of the art can be eliminated by arranging that the lug or lugs 7*a* located upon the intake side "E" terminate slightly by the dimension "y" from the external diameter of the cutter disks 1*a*, 2*a*, since by this solution the intake angle $A_1$ on the feed side "E" becomes considerably larger than the angle $A_2$ on the material outlet side and the crumpled paper thus comes into contact with a larger region of the rough circumference of the cutter disk and thus is just as securely drawn in as would be the case by a separate intake roller.

I claim:

1. A wiper arrangement for a cutting mechanism, comprising a pair of slitting rollers, each comprising a roller core having an axle with said roller cores being in spaced relation forming a gap therebetween for passing material to be cut therethrough, annular disk-like cutters mounted on each of said roller cores in spaced relation with said cutters extending into the gap, said cutters on different said roller cores being in overlapping side-by-side relation, wiper means between adjacent said disk-like cutters on each said roller core, said wiper means comprises a pair of wiper sections on each said roller core between adjacent said cutters, said roller cores defining a plane extending through the axes of said roller cores and across the gap therebetween, each said pair of wiper sections having one wiper section on one side of said plane and the other wiper section on the opposite side of said plane, each said wiper section having a top portion and a base portion with said top section being located adjacent said gap and said base portion being located more remote from said gap than said top portion and said base portion extending outwardly from said roller core, each said wiper section being supported on a different first support rod extending through said base portion thereof, and a second support rod located in said plane and supporting each of said wiper sections of said pair in the base portion thereof on the opposite side of said roller core from said gap, said base portion of each said pair of wiper sections being in close relation between said core and said second support rod and said second support rod serving as a common support for each of said wiper sections of said pair of wiper sections.

2. A wiper arrangement, as set forth in claim 1, wherein each said base portion has a recess therein spaced outwardly from said plane and said second support rod being located in said recess.

3. A wiper arrangement, as set forth in claim 1, wherein each said top portion extends from a plane tangential to said roller core at said gap outwardly from said gap.

4. A wiper arrangement, as set forth in claim 3, wherein said one wiper section has a lug adjacent said gap, with said lug located radially inwardly from the outer circumference from the adjacent said disk-like cutters and with a recessed portion extending inwardly from said lug on the side thereof more remote from said gap.

5. A wiper arrangement, as set forth in claim 4, wherein said other wiper section has a lug adjacent said gap projecting radially outwardly beyond the outer circumference of the adjacent said disk-like cutters and a recess located in said other wiper section adjacent said lug on the opposite side of said lug from said gap.

6. A wiper arrangement, as set forth in claim 4, wherein said recess extends inwardly at least for a depth as great as the depth of respective transverse grooves of said disk-like cutters.

7. A wiper arrangement, as set forth in claim 1, wherein said wiper sections are symmetrical on opposite sides of said plane with the exception of lugs and recesses formed in the top portions of said wiper section adjacent said gap.

8. A wiper arrangement, as set forth in claim 7, wherein one of said lugs extends outwardly from one of said wiper sections to the outer circumferential periphery of the adjacent said wipers.

* * * * *